US012123129B2

(12) United States Patent
Yegenoglu

(10) Patent No.: US 12,123,129 B2
(45) Date of Patent: Oct. 22, 2024

(54) IRONING BOARD EQUIPPED WITH A RESERVOIR HAVING CHAMBERS CHANGEABLE IN SIZE AND NUMBER

(71) Applicant: Sundus Bennur Yegenoglu, Roswell, GA (US)

(72) Inventor: Sundus Bennur Yegenoglu, Roswell, GA (US)

(73) Assignee: IP Assets LLC, Alpharetta, GA (US)

( * ) Notice: Subject to any disclaimer, the term of this patent is extended or adjusted under 35 U.S.C. 154(b) by 318 days.

(21) Appl. No.: 17/434,373

(22) PCT Filed: Feb. 25, 2020

(86) PCT No.: PCT/TR2020/050145

§ 371 (c)(1),
(2) Date: Aug. 26, 2021

(87) PCT Pub. No.: WO2020/176058

PCT Pub. Date: Sep. 3, 2020

(65) Prior Publication Data

US 2022/0098788 A1 Mar. 31, 2022

(30) Foreign Application Priority Data

Feb. 28, 2019 (TR) ..... TR2019/03077

(51) Int. Cl.
*D06F 81/00* (2006.01)

(52) U.S. Cl.
CPC ..... *D06F 81/003* (2013.01)

(58) Field of Classification Search
CPC ..... D06F 81/00; D06F 81/14; D06F 81/003
See application file for complete search history.

(56) References Cited

U.S. PATENT DOCUMENTS

| | | | | | |
|---|---|---|---|---|---|
| 702,242 | A * | 6/1902 | Oniel | D06F 81/006 | 38/111 |
| 957,537 | A * | 5/1910 | Bean | D06F 81/006 | 38/111 |
| 1,062,669 | A * | 5/1913 | Tate | D06F 81/006 | 38/111 |
| 2,247,177 | A * | 6/1941 | Rueping | D06F 81/006 | 38/111 |
| 2,506,479 | A * | 5/1950 | Zelzer | D06F 81/006 | 38/111 |
| 4,154,010 | A | 5/1979 | Evans | | |
| 4,535,921 | A * | 8/1985 | Sanders | D06F 81/00 | 38/106 |
| 4,807,760 | A | 2/1989 | Sussman | | |

(Continued)

FOREIGN PATENT DOCUMENTS

| | | |
|---|---|---|
| TR | 2019 01454 | 3/2019 |
| TR | 2019/03077 | 3/2019 |

(Continued)

*Primary Examiner* — Ismael Izaguirre
(74) *Attorney, Agent, or Firm* — Sam Pierce

(57) ABSTRACT

The carrying element (3) of the present invention is formed in relation to the ironing surface (1) of the ironing board. The carrying element (3) is in the form of a reservoir that allows additional material storage. The reservoir consists of at least one plate guide (4). Plate guides (4) define the mounting guides that allow movable plates (5) to be attached and detached.

2 Claims, 2 Drawing Sheets

(56) References Cited

U.S. PATENT DOCUMENTS

Figure 1:
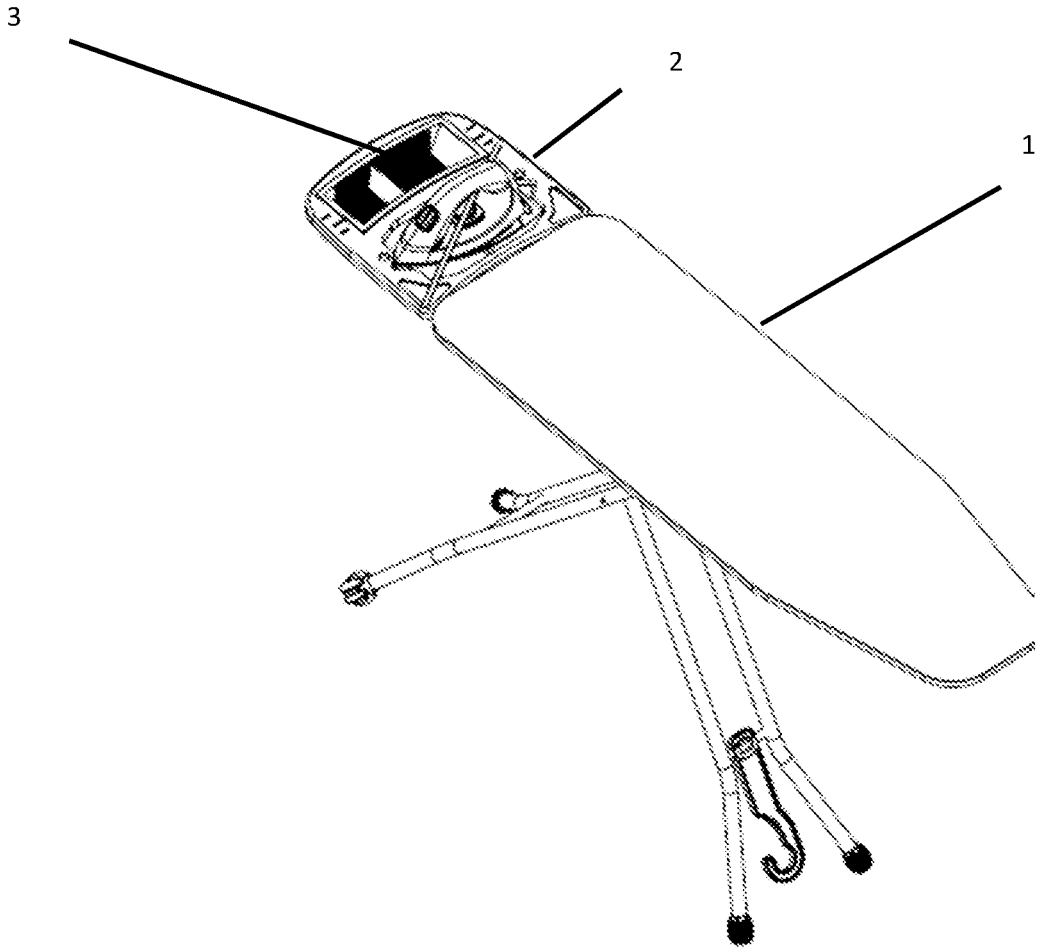

| | | | | |
|---|---|---|---|---|
| 7,062,871 | B1 * | 6/2006 | Smidt | A47B 77/10<br>38/104 |
| 2019/0367218 | A1 * | 12/2019 | Vega | B65D 25/30 |

FOREIGN PATENT DOCUMENTS

| | | | |
|---|---|---|---|
| TR | 2019/03075 | | 5/2019 |
| WO | 2006015448 | A1 | 2/2006 |
| WO | 2020176058 | A2 | 9/2020 |
| WO | 2020222708 | A2 | 11/2020 |

* cited by examiner

IRONING BOARD EQUIPPED WITH A RESERVOIR HAVING CHAMBERS CHANGEABLE IN SIZE AND NUMBER

CROSS-REFERENCE TO RELATED APPLICATIONS

This is a national stage application, filed under 35 U.S.C. § 371, of International Patent Application No. PCT/TR2020/050145, filed on Feb. 25, 2020, which claims the benefit of TR Application No. 2019/03077, filed on Feb. 28, 2019, the entireties of both applications are incorporated herein by reference.

TECHNICAL FIELD

The invention is related to an ironing board, having a reservoir that has chambers changeable in size and number, in order for different sized objects to be stored therein.

PRIOR ART

Mechanisms in the form of a table, which can be opened and closed in order to provide a flat surface for ironing, generally via foldable legs having an ironing board in order for an ironing process to be carried out thereon are defined as ironing boards.

Ironing boards generally have iron holders on ironing boards. Users place the iron on the iron holders when they are not using the iron during ironing.

However, users may need many different objects (laundry starch, ironing water, scents etc.) other than an iron during ironing. It is undesirable to place these items on the ironing board while ironing, since it will hinder the user from ironing easily.

Similarly, it is not a practical solution to place these objects on the iron holder. Particularly when the temperature of the iron is considered, it is possible for the objects that are placed on the iron holder to be damaged because of the hot iron. Moreover, the objects that are placed in this area can cause the iron to become unbalanced and fall. As a result the hot iron can harm both the user and its environment, and the iron can also be damaged as a result of this fall.

Users prefer keeping additional objects on the ironing board or on different structures that are part of the ironing board. Placing additional objects on a near surface will allow users to reach additional objects without extra effort and losing time. Keeping in mind that irons and similar products consume high-level of energy, keeping additional objects close to the ironing board will allow saving energy while ironing.

Therefore ironing boards may have external reservoirs that are associated with ironing surfaces.

The application numbered U.S. Pat. No. 9,512,557 discloses a carrying element that can be used by being hung at the end of the ironing board. The carrying element is in the form of a pouch that has several pockets, and it is preferably made of textile material. The carrying element is attached to the ironing board via a coupler and allows easy access to the additional objects for users while ironing.

A similar embodiment is mentioned in the patent application numbered US 2010/126050. According to the application, a carrying element in which additional elements can be stored therein and which is attached to the ironing board, is formed. It is understood that the carrying element is a part of the cover of the ironing board. Similarly, the embodiment subject to the application numbered US 2010/126050 is in the form of a pouch. Therefore, this embodiment is thought to be made of textile material.

The pouch-shaped carrying elements that are made of textiles and similar soft materials are generally used by hanging them on the side of the ironing board. In this case, the carrying element hangs down from the board and pouch cavities remain at a certain distance from the ironing board. Therefore users need to bend down to be able to reach inside the pouches and access the additional objects contained therein.

Another handicap of pouch-shaped carrying reservoirs is that small items are lost and cannot be found inside the pouches. For example, users will have a difficult time finding small objects such as buttons and needles that are placed in the pouches.

Another handicap of the pouch-shaped carrying elements is that they swing in the axis of the connection points since they are flexible. Particularly, when bottles containing liquids and similar packages are placed inside the pouches, the carrying element cans easily swing causing the liquids to spill.

Since pouch sizes are fixed and cannot be changed, large-sized objects cannot fit therein, and small sized objects get lost inside the pouch cavities or they cannot be held upright. This case can likewise hinder carrying additional objects safely.

To be able to eliminate these technical problems caused by pouch-shaped carrying elements, carrying elements that are s part of the ironing board or that can be mounted and dismounted are formed.

The application number U.S. Pat. No. 4,154,010 describes an ironing board that has reservoirs, which can be fashioned as an extension of the ironing board. The afore-mentioned ironing board has a detachable auxiliary apparatus. The aforesaid apparatus has multiple storage compartments to store safety pins, flat pins, clothes pins, buttons and various other ironing accessories for easy access. The apparatus also provides a hanger bar below the ironing board surface on which a clothes hanger can be hung.

As the apparatus that is subject to application number U.S. Pat. No. 4,154,010, is designed as an extension of the ironing board, users have easy access during ironing. The carrying element is formed in the shape of a reservoir and it has more than one chamber. However, the size and number of the chambers are fixed. If users wish to change the size and number of chambers, they have to dismount the apparatus and mount an additionally bought reservoir having different chamber sizes and/or numbers onto the board following laborious mounting procedures.

A similar embodiment is described in the application numbered DE19906239. The ironing board that is subject to the application is equipped with an extension surface. The extension surface can be disassembled and assembled, and it can also contain several chambers. However, similar technical problems can also be experienced if the embodiment subject to application number DE19906239 is used.

Application numbers U.S. Pat. Nos. 5,472,157, 5,136,798 and 3,913,878 disclose carrying elements that can carry additional objects. However, these structures are not fully capable of solving technical problems that may be encountered in existing systems.

A solution for the difficulties encountered cannot be found because the technically ordinary reservoirs that are used for ironing boards are fixed in dimension and it is impossible to alter them. Therefore users can only place objects that have certain sizes and specific dimensions into these carrying reservoirs. It is not possible to place larger objects with larger dimensions in these reservoirs. Similarly, if users place small-sized objects in these reservoirs, these objects will be too small for these chambers and may be lost inside.

In such a case, users may not be able to use the existing carrying element or may want to change the ironing board or may want to disassemble the carrying element and assemble a new one.

This causes the users to carry out extra expenses as they will have to buy additional elements; moreover users will have to show extra effort in order to create a new system by disassembling the old one.

Problems that the Invention Aims to Solve

The ironing board, which is the subject of the invention, is equipped with a carrying element that will be a part of the ironing board of the ironing board surface.

Thanks to the design of the carrying element which has been designed as an extension of the ironing board, users will not have to bend and reach down to the lower parts of the ironing board to be able to reach to the objects in the pouches.

In the preferred application of the ironing board subject to the invention, the carrying element is positioned at the end of the ironing board that has the ironing surface. Considering that ironing is conducted on the longer edge of the ironing board, the carrying element is positioned in the area that both provides easy access to users and does not hinder ironing. Therefore, users will be able to do tasks more easily during ironing.

The ironing board subject to the invention comprises a carrying element of which the size and numbers of chambers can be arranged. Therefore, different objects with different dimensions can easily be placed within the carrying element.

When the user wishes to place a large item inside the carrying element, the user can adjust the area that they desire to use by changing chamber sizes.

When users wish to store smaller items in the carrying element, they can likewise reduce the size and increase the number of chambers.

DESCRIPTIONS OF THE FIGURES

FIG. 1. Top perspective view of ironing board having the carrying element

Figure 2:
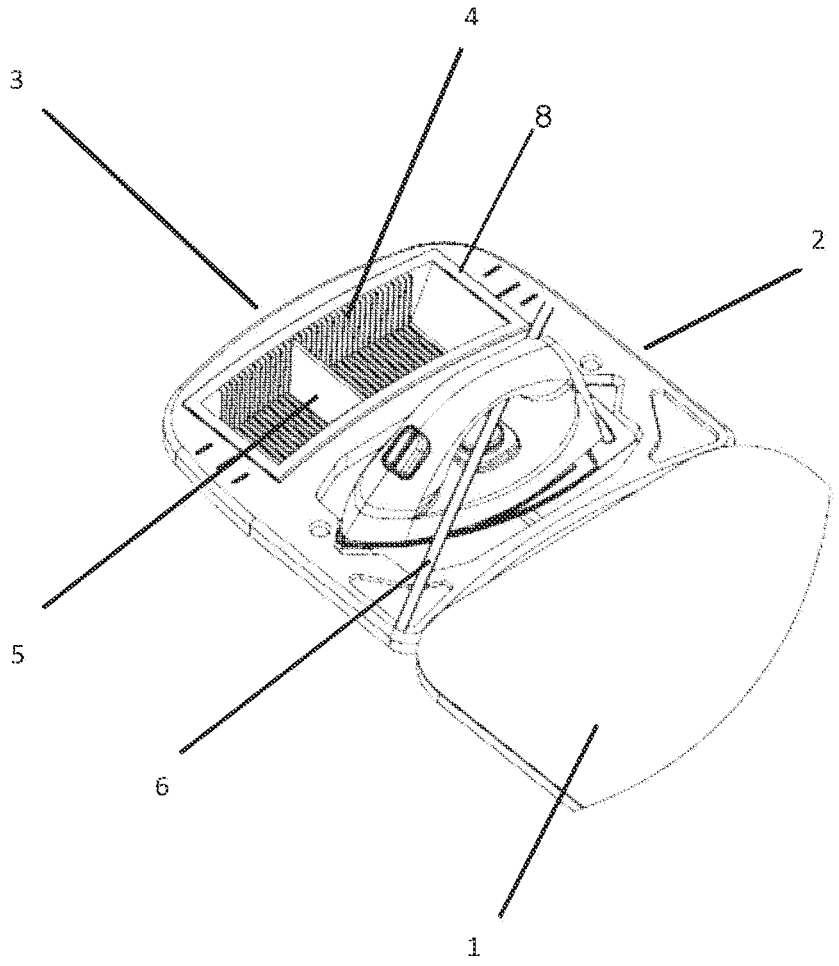

FIG. 2. Perspective view of the carrying element and the ironing surface as a single piece

DESCRIPTIONS OF THE REFERENCES ON THE FIGURES

1. Ironing surface
2. Iron holder
3. Carrying element
4. Plate guides
5. Movable plate
6. Belt

DESCRIPTION OF THE INVENTION

The carrying element (3) of the invention is formed in connection with the ironing surface (1) that belongs to the ironing board. The carrying element (3) is in the form of a reservoir that allows storing additional objects. The carrying element is seated in an opening in the ironing surface and includes a perimeter lip (8) that encircles the reservoir.

The reservoir comprises at least a plate guide (4) within its structure. The plate guides (4) define the mounting guides that allow movable plates (5) to be assembled and disassembled.

In the case that users do not place any movable plates (5) inside the carrying element (3) the largest reservoir area will be obtained. In this case, users can place additional large objects inside the reservoir.

When only 1 of the movable plates (5) is placed on the plate guides (4) 2 chambers will have been created in the reservoir which defines the carrying element (3) allowing different additional objects to be stored in two reservoirs.

When user places the 2 movable plates (5) on the plate guides (4), 3 chambers will be created in the reservoir that defines the carrying element (3). In this case, a user can easily store different additional objects in the carrying element.

FIG. 2 defines the carrying element (3), which has been equipped with several plate guides (4). This embodiment allows to form different sized and numbered chambers inside the reservoir.

According to FIG. 2 the plate guides (4) are located on the inner surface walls of the reservoir that forms the carrying element (3). As length of each movable plate (5) has a size that allows click fitting of the plates into the plate guides (4) firmly, the movable plates (5) will be able attached and detached into the plate guides (4) without carrying out an assembly-disassembly procedure.

According to FIG. 1 the ironing board comprises an iron holder (2) which is a part of the ironing surface (1). The iron holder (2), defines the surface on which the iron can be placed when it is not being used.

According to a preferred embodiment of the invention, the carrying element (3) defines a structure that is formed along the ironing surface (1). When considered in detail, the embodiments where the carrying element (3) is a part of the iron holder (2) is among preferred embodiments.

According to FIG. 2, the iron holder (2) is equipped with a belt (6). The belt (6) defines a fixing element that couples the iron to the ironing surface (1).

The invention claimed is:

1. An ironing board comprising:

an ironing surface; and a carrying element adapted to store objects used while ironing, the carrying element includes a reservoir, an outwardly extending perimeter lip that encircles the reservoir, a plate guide positioned in the reservoir, and a moveable plate, the plate guide is adapted to receive the moveable plate and thereby change the area and size of the reservoir;

wherein:

the carrying element is seated in an opening in the ironing board and positioned adjacent to an end of the ironing surface and supported by the ironing board.

2. The ironing board of claim 1, wherein the carrying element includes a plurality of plate guides that are formed on the inner walls of the reservoir defined by the carrying element.

* * * * *